US012799885B2

(12) United States Patent
Gupta et al.

(10) Patent No.: US 12,799,885 B2
(45) Date of Patent: Nov. 17, 2026

(54) AFTERTREATMENT DIAGNOSTIC SYSTEM

(71) Applicant: Cummins Emission Solutions Inc., Columbus, IN (US)

(72) Inventors: Ajita Gupta, Sihora (IN); Rakesh Mohanty, Atlanta, GA (US); Michael Haas, Columbus, IN (US); Jinqian Gong, Columbus, IN (US); Arun Shori Sundaravel Damotharan, Columbus, IN (US)

(73) Assignee: Cummins Emission Solutions Inc., Columbus, IN (US)

( * ) Notice: Subject to any disclaimer, the term of this patent is extended or adjusted under 35 U.S.C. 154(b) by 455 days.

(21) Appl. No.: 18/437,036

(22) Filed: Feb. 8, 2024

(65) Prior Publication Data

US 2024/0271555 A1 Aug. 15, 2024

Related U.S. Application Data

(60) Provisional application No. 63/444,407, filed on Feb. 9, 2023.

(51) Int. Cl.
*F01N 11/00* (2006.01)
*F01N 3/20* (2006.01)

(52) U.S. Cl.
CPC ..... *F01N 11/007* (2013.01); *F01N 3/208* (2013.01); *F01N 2900/0421* (2013.01); *F01N 2900/1616* (2013.01)

(58) Field of Classification Search
CPC ..... F01N 11/007; F01N 3/208; F01N 2900/0421; F01N 2900/1616
See application file for complete search history.

(56) References Cited

U.S. PATENT DOCUMENTS

| | | | | |
|---|---|---|---|---|
| 7,736,595 | B2 | 6/2010 | Gady et al. | |
| 8,387,368 | B2 | 3/2013 | Parmentier et al. | |
| 8,635,007 | B2 | 1/2014 | Balenovic et al. | |
| 2008/0156569 | A1* | 7/2008 | Clevenger | F01N 13/08 180/309 |
| 2015/0337772 | A1* | 11/2015 | Lim | F02D 41/005 60/299 |
| 2017/0306819 | A1* | 10/2017 | Alfieri | F01N 9/005 |
| 2018/0163604 | A1* | 6/2018 | Wang | F01N 9/005 |
| 2019/0292968 | A1* | 9/2019 | Grünbeck | B01D 53/9418 |

FOREIGN PATENT DOCUMENTS

| | | | | |
|---|---|---|---|---|
| DE | 102016211575 | A1 * | 12/2017 | F01N 3/2006 |
| DE | 102017201393 | A1 * | 8/2018 | F01N 11/00 |

* cited by examiner

*Primary Examiner* — Catherine T. Rastovski
*Assistant Examiner* — Sharah Zaab
(74) *Attorney, Agent, or Firm* — Foley & Lardner LLP

(57) ABSTRACT

A controller to diagnose a selective catalytic reduction (SCR) system of an aftertreatment system executes computer-readable instructions to determine a first NOx value at an outlet of the SCR system, determine an ammonia (NH3) slip value based at least in part on the first NOx value, determine a second NOx value of a healthy SCR model, determine a third NOx value of a degraded SCR model, compute at least one degradation factor based on the ammonia slip, the first NOx value, the second NOx value, and the third NOx value, and diagnose a normal operation or an abnormal operation of the SCR system based on the at least one degradation factor.

20 Claims, 8 Drawing Sheets

388

384

AFTERTREATMENT DIAGNOSTIC SYSTEM

CROSS-REFERENCE TO RELATED PATENT APPLICATIONS

The present application claims the benefit of U.S. Provisional Patent Application No. 63/444,407, filed Feb. 9, 2023, the entire contents of which are hereby incorporated by reference herein.

BACKGROUND

The present disclosure relates generally to aftertreatment diagnostic systems. More specifically, the present disclosure relates to aftertreatment diagnostic systems that determine if a selective catalytic reduction catalyst has failed.

SUMMARY

One embodiment relates to an aftertreatment diagnostic system that includes one or more memory devices having computer-readable instructions stored thereon, and one or more processors programmed to execute the computer-readable instructions to: determine a first NOx value at an outlet of a Selective Catalytic Reduction (SCR) system of an aftertreatment system; determine an ammonia (NH3) slip value based at least in part on the first NOx value; determine a second NOx value of a healthy SCR model; determine a third NOx value of a degraded SCR model; compute at least one degradation factor based on the ammonia slip, the first NOx value, the second NOx value, and the third NOx value; and diagnose a normal operation or an abnormal operation of the SCR system based on the degradation factor.

In some embodiments, the one or more processors are programmed to compute the at least one degradation factor by determining a first degradation factor as (the first NOx value−the NH3 slip value−the healthy NOx value)/(the degraded NOx value−the healthy NOx value) when the NH3 slip value is greater than an NH3 slip threshold.

In some embodiments, the one or more processors are programmed to compute the at least one degradation factor by determining a second degradation factor as (the first NOx value−the healthy NOx value)/(the degraded NOx value−the healthy NOx value) when the NH3 slip value is less than an NH3 slip threshold.

In some embodiments, the one or more processors are programmed to compute the at least one degradation factor by: determining a first degradation factor as (the first NOx value−the NH3 slip value−the healthy NOx value)/(the degraded NOx value−the healthy NOx value) when the NH3 slip value is greater than an NH3 slip threshold; and determining a second degradation factor as (the first NOx value−the healthy NOx value)/(the degraded NOx value−the healthy NOx value) when the NH3 slip value is less than an NH3 slip threshold. In some embodiments, the one or more processors are programmed to compute the at least one degradation factor by determining the first degradation factor during a first sampling period, and determining the second degradation factor during a second sampling period. In some embodiments, the one or more processors are programmed to diagnose the normal operation or the abnormal operation of the SCR system by determining that operation of the SCR system corresponds to the healthy SCR model based on the degradation factor being within a predetermined threshold, and determining that operation of the SCR system corresponds to the degraded SCR model based on the degradation factor being greater than the predetermined threshold.

In some embodiments, the one or more processors are programmed to diagnose the normal operation or the abnormal operation of the SCR system by sorting the at least one degradation factor into one of a plurality of weight factor bins after a sampling period, determine a total count in each of the plurality of weight factor bins at the end of a predetermined time period, and diagnose the normal operation or the abnormal operation of the SCR system based on the total count. In some embodiments, the plurality of weight factor bins includes a plurality of failed weight factor bins and a plurality of healthy weight factor bins and the one or more processors are programmed to diagnose the normal operation or the abnormal operation of the SCR system by determining a failed count within the plurality of failed weight factor bins, determining a healthy count within the plurality of healthy weight factor bins, and diagnosing the normal operation or the abnormal operation of the SCR system based on a ratio of the failed count and the total count. In some embodiments, the one or more processors are programmed to diagnose the normal operation or the abnormal operation of the SCR system by comparing the ratio of the failed count and the total count to a threshold, selecting two of the plurality of failed weight factor bins including the highest counts, determining a pre-filtered output based on a weighted average of the selected two failed weight factor bins, determining a post-filtered output using by passing the pre-filtered output through an exponential weighted moving average filter on the two selected bins, and generating a fault code based on the post-filtered output.

In some embodiments, a non-transitory computer-readable medium includes computer-readable instructions stored thereon that when executed by one or more processors of a controller cause the one or more processors to determine a first NOx value at an outlet of a selective catalytic reduction (SCR) system of an aftertreatment system, determine an ammonia (NH3) slip value based at least in part on the first NOx value, determine a second NOx value of a healthy SCR model, determine a third NOx value of a degraded SCR model, compute at least one degradation factor based on the ammonia slip, the first NOx value, the second NOx value, and the third NOx value, and diagnose a normal operation or an abnormal operation of the SCR system based on the at least one degradation factor.

In some embodiments, to compute the at least one degradation factor, the one or more processors execute computer-readable instructions to determine that the NH3 slip value is greater than an NH3 slip threshold and responsive to determining that the NH3 slip value is greater than the NH3 slip threshold, compute a first degradation factor of the at least one degradation factor by dividing a first value by a second value, the first value being a function of the first NOx value, the NH3 slip value, and the second NOx value, and the second value being a function of the third NOx value and the second NOx value. In some embodiments, to compute the at least one degradation factor, the one or more processors execute computer-readable instructions to determine that the NH3 slip value is less than an NH3 slip threshold and responsive to determining that the NH3 slip value is less than the NH3 slip threshold, compute a second degradation factor of the at least one degradation factor by dividing a first value by a second value, the first value being a function of the first NOx value and the second NOx value, and the second value being a function of the third NOx value and the second NOx value.

In some embodiments, to compute the at least one degradation factor, the one or more processors execute computer-readable instructions to compute a first degradation factor of the at least one degradation factor by dividing a first value by a second value, the first value being a function of the first NOx value, the NH3 slip value, and the second NOx value, and the second value being a function of the third NOx value and the second NOx value responsive to determining that the NH3 slip value is greater than an NH3 slip threshold and compute a second degradation factor of the at least one degradation factor by dividing a first value by a second value, the first value being a function of the first NOx value and the second NOx value, and the second value being a function of the third NOx value and the second NOx value responsive to determining that the NH3 slip value is less than the NH3 slip threshold.

In some embodiments, the one or more processors execute computer-readable instructions to compute the first degradation factor during a first sampling period and compute the second degradation factor during a second sampling period. In some embodiments, to diagnose the normal operation or the abnormal operation of the SCR system, the one or more processors execute computer-readable instructions to determine that operation of the SCR system corresponds to the healthy SCR model based on the at least one degradation factor being within a predetermined threshold and determine that the operation of the SCR system corresponds to the degraded SCR model based on the at least one degradation factor being greater than the predetermined threshold.

In some embodiments, to diagnose the normal operation or the abnormal operation of the SCR system, the one or more processors execute computer-readable instructions to sort each of the at least one degradation factor into one of a plurality of weight factor bins after a sampling period, determine a total count in each of the plurality of weight factor bins at the end of a predetermined time period, and diagnose the normal operation or the abnormal operation of the SCR system based on the total count. In some embodiments, the plurality of weight factor bins includes a plurality of failed weight factor bins and a plurality of healthy weight factor bins, and to diagnose the normal operation or the abnormal operation of the SCR system, the one or more processors execute computer-readable instructions to determine a failed count within the plurality of failed weight factor bins and diagnose the normal operation or the abnormal operation of the SCR system based on a ratio of the failed count and the total count.

In some embodiments, to diagnose the normal operation or the abnormal operation of the SCR system, the one or more processors execute computer-readable instructions to determine that the ratio is greater than a threshold, select a subset of the plurality of failed weight factor bins including the highest counts of the at least one degradation factor based on the ratio being greater than the threshold, compute a pre-filtered output based on a weighted average of the selected subset of the plurality of failed weight factor bins, compute a post-filtered output by passing the pre-filtered output through an exponential weighted moving average filter, and generate a fault code based on the post-filtered output indicating that the SCR system is abnormal. In some embodiments, the subset of the plurality of failed weight factor bins comprises two of the plurality of failed weight factor bins.

In some embodiments, to diagnose the normal operation or the abnormal operation of the SCR system, the one or more processors execute computer-readable instructions to determine that the ratio is less than a threshold, select a subset of the plurality of healthy weight factor bins including the lowest counts of the at least one degradation factor based on the ratio being less than the threshold, compute a pre-filtered output based on a weighted average of the selected subset of the plurality of healthy weight factor bins, compute a post-filtered output by passing the pre-filtered output through an exponential weighted moving average filter, and determine that the SCR system is normal based on the post-filtered output. In some embodiments, the subset of the plurality of healthy weight factor bins comprises two of the plurality of healthy weight factor bins.

In some embodiments, a system includes an aftertreatment system having the selective catalytic reduction (SCR) system and a controller having one or more processors and the non-transitory computer-readable medium.

In some embodiments, a method includes determining, by at least one controller, a first NOx value at an outlet of a selective catalytic reduction (SCR) system of an aftertreatment system, determining, by the at least one controller, an ammonia (NH3) slip value based at least in part on the first NOx value, determining, by the at least one controller, a second NOx value of a healthy SCR model, determining, by the at least one controller, a third NOx value of a degraded SCR model, computing, by the at least one controller, at least one degradation factor based on the ammonia slip, the first NOx value, the second NOx value, and the third NOx value, and diagnosing, by the at least one controller, a normal operation or an abnormal operation of the SCR system based on the at least one degradation factor.

In some embodiments, to compute the at least one degradation factor, the method includes computing, by the at least one controller, a first degradation factor of the at least one degradation factor by dividing a first value by a second value, the first value being a function of the first NOx value, the NH3 slip value, and the second NOx value, and the second value being a function of the third NOx value and the second NOx value responsive to determining that the NH3 slip value is greater than an NH3 slip threshold and computing, by the at least one controller, a second degradation factor of the at least one degradation factor by dividing a first value by a second value, the first value being a function of the first NOx value and the second NOx value, and the second value being a function of the third NOx value and the second NOx value responsive to determining that the NH3 slip value is less than the NH3 slip threshold.

In some embodiments, to diagnose the normal operation or the abnormal operation of the SCR system, the method includes sorting, by the at least one controller, each of the at least one degradation factor into one of a plurality of weight factor bins after a sampling period, determining, by the at least one controller, a total count in each of the plurality of weight factor bins at the end of a predetermined time period, and diagnosing, by the at least one controller, the normal operation or the abnormal operation of the SCR system based on the total count.

In some embodiments, the plurality of weight factor bins includes a plurality of failed weight factor bins and a plurality of healthy weight factor bins, and to diagnose the normal operation or the abnormal operation of the SCR system, the method includes determining, by the at least one controller, a failed count within the plurality of failed weight factor bins, and diagnosing, by the at least one controller, the normal operation or the abnormal operation of the SCR system based on a ratio of the failed count and the total count.

In some embodiments, to diagnose the normal operation or the abnormal operation of the SCR system, the method includes determining, by the at least one controller, that the ratio is greater than a threshold, selecting, by the at least one controller, a subset of the plurality of failed weight factor bins including the highest counts of the at least one degradation factor based on the ratio being greater than the threshold, computing, by the at least one controller, a pre-filtered output based on a weighted average of the selected subset of the plurality of failed weight factor bins, computing, by the at least one controller, a post-filtered output by passing the pre-filtered output through an exponential weighted moving average filter, and generating, by the at least one controller, a fault code based on the post-filtered output indicating that the SCR system is abnormal.

In some embodiments, to diagnose the normal operation or the abnormal operation of the SCR system, the method includes determining, by the at least one controller, that the ratio is less than a threshold, selecting, by the at least one controller, a subset of the plurality of healthy weight factor bins including the lowest counts of the at least one degradation factor based on the ratio being less than the threshold, computing, by the at least one controller, a pre-filtered output based on a weighted average of the selected subset of the plurality of healthy weight factor bins, computing, by the at least one controller, a post-filtered output by passing the pre-filtered output through an exponential weighted moving average filter, and determining, by the at least one controller, that the SCR system is normal based on the post-filtered output. In some embodiments, the subset of the plurality of healthy weight factor bins comprises two of the plurality of healthy weight factor bins.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Following below are more detailed descriptions of various concepts related to, and implementations of, methods, apparatuses, and systems for aftertreatment system diagnostics. Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring to the figures generally, the various embodiments disclosed herein relate to systems, apparatuses, and methods for diagnosing Selective Catalytic Reduction (SCR) catalyst failure or degradation during a normal operation and during an ammonia (NH3) slip event. A normal operation calculation is used to determine a degree of degradation during normal operation, and a NH3 slip calculation is used to determine a degree of degradation during the NH3 slip event. Calculated outputs from the calculations are sorted into weight factor bins and a distribution of the calculated outputs within the weight factor bins is used to identify failures of the SCR catalyst. Embodiments described herein provide an aftertreatment diagnostic system that monitors for catalyst degradation both during normal operation and during NH3 slip events.

Figure 1:
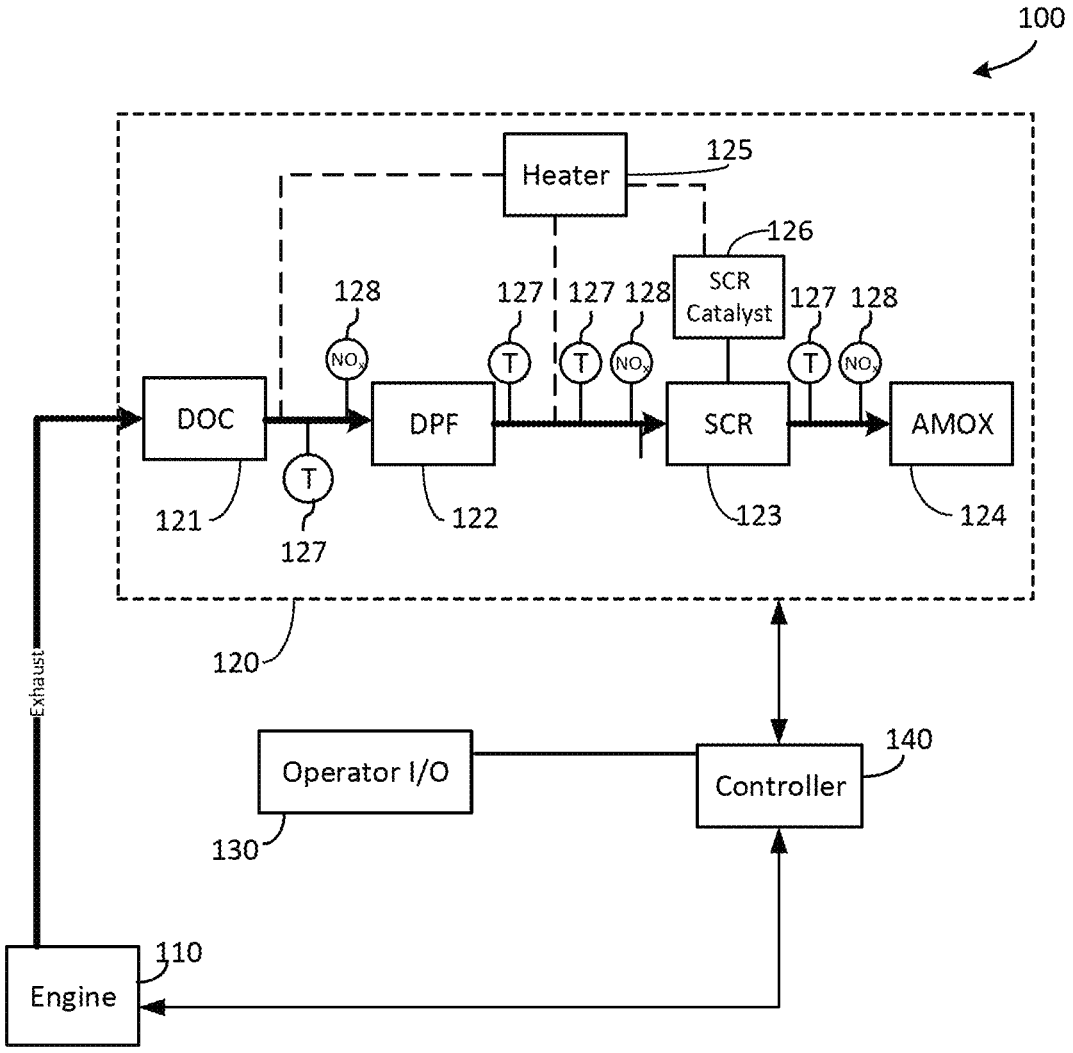
FIG. 1 is a schematic representation of an engine system including an aftertreatment diagnostic system according to some embodiments.

As shown in FIG. 1, an engine system 100 includes an engine 110, an aftertreatment system 120, an operator input/output (I/O) device 130, and a controller 140 communicably coupled to each of the aforementioned components to control operation of the engine system 100. In the configuration of FIG. 1, the engine system 100 is included in a vehicle. The vehicle may be any type of on-road or off-road vehicle including, but not limited to, wheel-loaders, fork-lift trucks, line-haul trucks, mid-range trucks (e.g., pick-up truck, etc.), sedans, coupes, tanks, airplanes, boats, and any other type of vehicle. In another embodiment, the engine system 100 is embodied in a stationary piece of equipment, such as a power generator or generator set.

The engine 110 may be any type of engine that generates exhaust gas, such as a gasoline, natural gas, or diesel engine, a hybrid engine (e.g., a combination of an internal combustion engine and an electric motor), and/or any other suitable engine. In the example shown, the engine 110 is a diesel-powered compression-ignition engine.

The aftertreatment system 120 is coupled to and, particularly, in exhaust-gas receiving communication with the engine 110. The aftertreatment system 120 includes a diesel oxidation catalyst (DOC) 121, a diesel particulate filter (DPF) 122, a selective catalytic reduction (SCR) system 123, an ammonia oxidation catalyst (AMOX) 124, and a heater 125.

The DOC 121 is structured to receive the exhaust gas from the engine 110 and to oxidize hydrocarbons and carbon monoxide in the exhaust gas. In some embodiments, the DOC 121 is maintained at a certain operating temperature. In some embodiments, this certain operating temperature is approximately between 200-500° C. In some embodiments, the certain operating temperature is the temperature at which the conversion efficiency of the DOC 121 exceeds a predefined threshold (e.g., the conversion of HC to less harmful compounds, which is known as the HC conversion efficiency).

The DPF 122 is arranged or positioned downstream of the DOC 121 and structured to remove particulates, such as soot, from exhaust gas flowing in the exhaust gas stream. The DPF 122 includes an inlet, where the exhaust gas is received, and an outlet, where the exhaust gas exits after having particulate matter substantially filtered from the exhaust gas and/or converting the particulate matter into carbon dioxide. In some implementations, the DPF 122 may be omitted.

The aftertreatment system 120 further includes a reductant delivery system that includes a decomposition chamber (e.g., decomposition reactor, reactor pipe, decomposition tube, reactor tube, etc.) to convert a reductant into ammonia. The reductant may be, for example, urea, diesel exhaust fluid (DEF), Adblue®, a urea water solution (UWS), an aqueous urea solution (e.g., AUS32, etc.), and other similar fluids. The reductant is added to the exhaust gas stream to aid in the catalytic reduction. The reductant may be injected by a reductant doser to a location upstream of the SCR system 123 generally, or in particular, upstream of an SCR catalyst 126, such that the SCR catalyst 126 receives a mixture of the reductant and exhaust gas. However, in other embodiments, the reductant doser may inject reductant at any point in the aftertreatment system 120, including within the SCR catalyst 126 itself. The reductant droplets then undergo the processes of evaporation, thermolysis, and hydrolysis to form gaseous ammonia within the decomposition chamber, the SCR catalyst 126, and/or the exhaust gas conduit system, which leaves the aftertreatment system 120. The doser may have any construction and structure for injecting reductant into the exhaust aftertreatment system.

The SCR 123 includes the SCR catalyst 126 and is configured to assist in the reduction of NOx emissions by accelerating a NOx reduction process between the ammonia and the NOx of the exhaust gas into diatomic nitrogen, water, and/or carbon dioxide. If the SCR catalyst 126 is not at or above a certain temperature, the acceleration of the NOx reduction process is limited and the SCR 123 may not be operating at a level of efficiency to meet or likely meet regulations. In some embodiments, this certain temperature is approximately 200-300° C. The SCR catalyst 126 may be made from a combination of an inactive material and an active catalyst, such that the inactive material, (e.g., ceramic metal) directs the exhaust gas towards the active catalyst, which is any sort of material suitable for catalytic reduction (e.g., base metals oxides like vanadium, molybdenum, tungsten, etc., or noble metals like platinum).

In some embodiments, the AMOX 124 is included in the aftertreatment system. The AMOX 124 is structured to address ammonia slip by removing or attempting to remove excess ammonia from the treated exhaust gas before the treated exhaust is released into the atmosphere.

In some embodiments, the heater 125 is located in the exhaust flow path before the aftertreatment system 120 and is structured to controllably heat the exhaust gas upstream of the aftertreatment system 120. In some embodiments, the heater 125 is located directly before the DOC 121, while in other embodiments, the heater 125 is located directly before the SCR 123 or is directly incorporated into the SCR catalyst 126. The heater 125 may be any sort of external heat source that can be structured to increase the temperature of passing exhaust gas, which, in turn, increases the temperature of components in the aftertreatment system 120, such as the DOC 121 or the SCR 123. As such, the heater 125 may be an electric heater, an induction heater, a microwave, or a fuel-burning (e.g., HC fuel) heater. As shown here, the heater 125 is an electric heater that draws power from a battery of the engine system 100 (or, another electric source, such as an alternator, super-capacitor, etc.). The heater 125 may be controlled by the controller 140 (e.g., turn on, turn off, turn to various degrees of power to change the heater output power, etc.). The heater 125 may be positioned proximate a desired component to heat the component (e.g., DPF) by conduction (and possibly convection). Multiple heaters may be used with the exhaust aftertreatment system, and each may be structured the same or differently (e.g., conduction, convection, etc.).

Referring still to FIG. 1, the operator input/output (I/O) device 130 is communicably coupled to the controller 140, such that information may be exchanged between the controller 140 and the I/O device 130. The information may relate to one or more components of FIG. 1 or determinations (described below) of the controller 140. The operator I/O device 130 enables an operator of the engine system 100 to communicate with the controller 140 and one or more components of the engine system 100 of FIG. 1. For example, the operator I/O device 130 may include, but is not limited to, an interactive display, a touchscreen device, one or more buttons and switches, voice command receivers, a mobile device, etc.

The engine system 100 includes a sensor array including a plurality of sensors. The sensors are coupled to the controller 140, such that the controller 140 can monitor and acquire information indicative of operation of the engine system 100. In this regard, the sensors include NOx sensors 128 and temperature sensors 127. The NOx sensors 128 are structured to acquire information indicative of a NOx amount at or approximately at their disposed location. The temperature sensors 127 acquire information indicative of an approximate temperature of the exhaust gas at or approximately at their disposed location. In some of these embodiments, the first and second temperature sensors 127 are located outside of the SCR catalyst 126, such that the first temperature sensor 127 is located upstream of the entire SCR catalyst 126 and the second temperature sensor 127 is located downstream of the entire SCR catalyst 126. Further, the engine system 100 includes at least one sensor for a gas species (i.e., NOx or ammonia) located downstream of at least one portion of the SCR catalyst 126, and one or more sensors may be included upstream of the SCR catalyst 126 in order to monitor conditions at the catalyst inlet (e.g., an amount of NOx, a temperature of the exhaust entering the SCR catalyst 126, a mass flow rate of exhaust at the SCR catalyst 126 inlet, etc.). However, it should be understood that the depicted locations, numbers, and type of sensors is illustrative only. In some embodiments, one or more of the sensors may be virtual sensors, such that the one or more sensors estimate output variables (e.g., information indicative of a NOx amount, information indicative of an approximate temperature, etc.) based on other operating parameters within the system. In other embodiments, the sensors may be positioned in other locations, there may be more or less sensors than shown, and/or different/additional sensors may also be included with the engine system 100 (e.g., a pressure sensor, an ammonia sensor, a flow rate sensor, etc.).

The controller 140 is structured to control, at least partly, the operation of the engine system 100 and associated sub-systems, such as the engine 110, aftertreatment system 120, and the operator input/output (I/O) device 130. Communication between and among the components may be via any number of wired or wireless connections. For example, a wired connection may include a serial cable, a fiber optic cable, a CAT5 cable, or any other form of wired connection. In comparison, a wireless connection may include the Internet, Wi-Fi, cellular, radio, etc. In one embodiment, a controller area network (CAN) bus provides the exchange of signals, information, and/or information. The CAN bus includes any number of wired and wireless connections. Because the controller 140 is communicably coupled to the systems and components of FIG. 1, the controller 140 is structured to receive information from one or more of the components shown in FIG. 1. The structure and function of the controller 140 is further described in regard to FIG. 2.

As the components of FIG. 1 are shown to be embodied in the engine system 100, the controller 140 may be structured as one or more electronic control units (ECU). The controller 140 may be separate from or included with at least one of a transmission control unit, an exhaust aftertreatment control unit, a powertrain control module, an engine control module, etc. The function and structure of the controller 140 is described in greater detail in FIG. 2.

Figure 2:
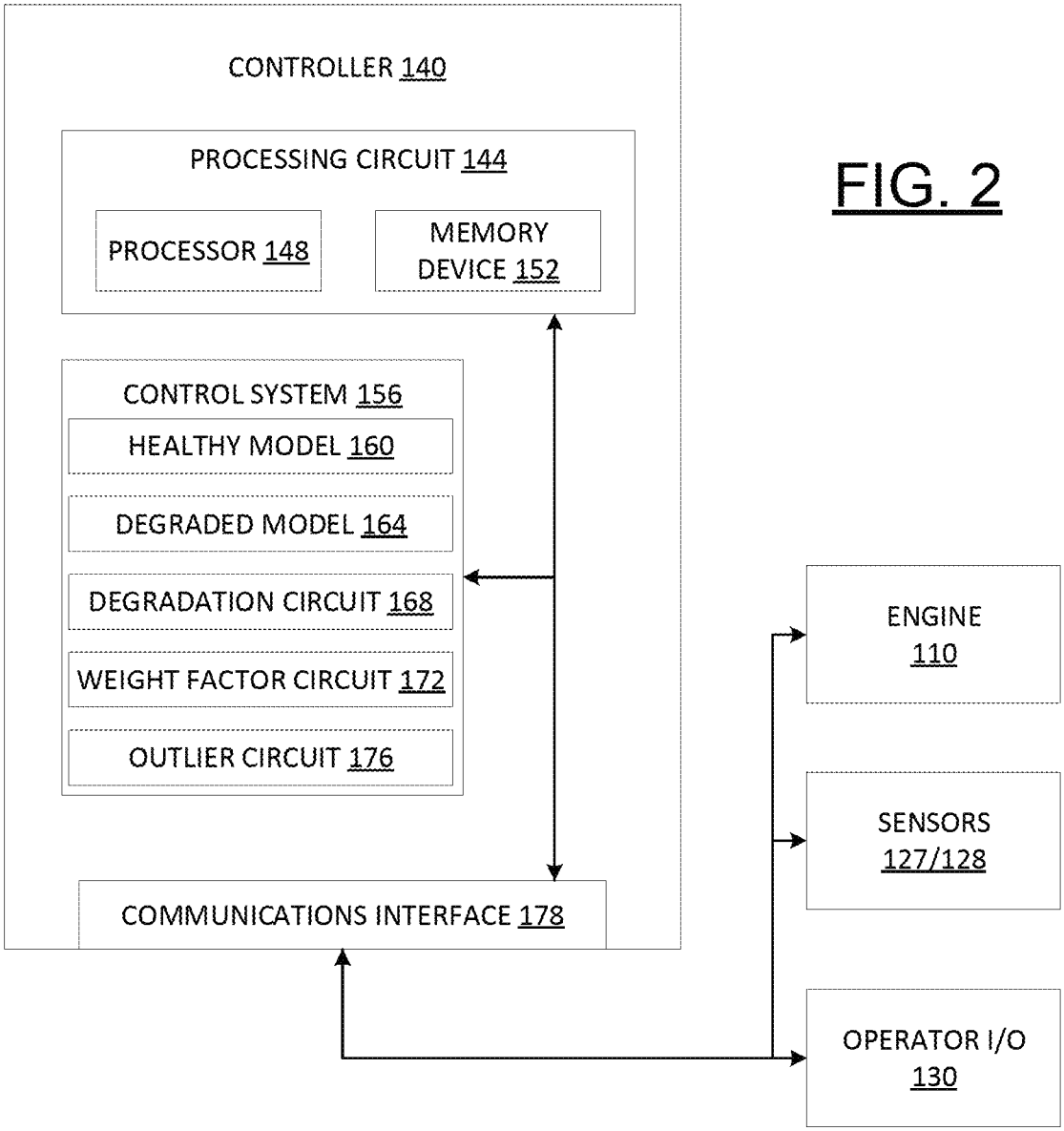
FIG. 2 is a schematic representation of a controller of the aftertreatment diagnostic system of FIG. 1 according to some embodiments.

Referring now to FIG. 2, a schematic diagram of the controller 140 of the engine system 100 of FIG. 1 is shown according to an example embodiment. As shown in FIG. 2, the controller 140 includes a processing circuit 144 having a processor 148 and a memory device 152, a control system 156 having a healthy model 160, a degraded model 164, a degradation circuit 168, a weight factor circuit 172, and an outlier circuit 176, and a communications interface 178. Generally, the engine system 100 includes an aftertreatment diagnostic system in the form of a controller 140 that is structured to monitor the aftertreatment system 120. The controller 140 includes one or more memory devices having computer-readable instructions stored thereon, and one or more processors programmed to execute the computer-readable instructions to: determine a first NOx value at an outlet of a Selective Catalytic Reduction (SCR) system of an aftertreatment system; determine an ammonia (NH3) slip value based at least in part on the first NOx value; determine a second NOx value of a healthy SCR model; determine a third NOx value of a degraded SCR model; compute at least one degradation factor based on the ammonia slip, the first NOx value, the second NOx value, and the third NOx value; and diagnose a normal operation or an abnormal operation of the SCR system based on the degradation factor.

In one configuration, the control system 156 is embodied as machine or computer-readable media that is executable by a processor, such as processor 148. As described herein and amongst other uses, the machine-readable media facilitates performance of certain operations to enable reception and transmission of information. For example, the machine-readable media may provide an instruction (e.g., command, etc.) to, e.g., acquire information. In this regard, the machine-readable media may include programmable logic that defines the frequency of acquisition of the information (or, transmission of the information). The computer readable media may include code, which may be written in any programming language including, but not limited to, Java or the like and any conventional procedural programming languages, such as the "C" programming language or similar programming languages. The computer readable program code may be executed on one processor or multiple remote processors. In the latter scenario, the remote processors may be connected to each other through any type of network (e.g., CAN bus, etc.).

In another configuration, the control system 156 is embodied as hardware units, such as electronic control units. As such, the control system 156 may be embodied as one or more circuitry components including, but not limited to, processing circuitry, network interfaces, peripheral devices, input devices, output devices, sensors, etc. In some embodiments, the control system 156 may take the form of one or more analog circuits, electronic circuits (e.g., integrated circuits (IC), discrete circuits, system on a chip (SOCs) circuits, microcontrollers, etc.), telecommunication circuits, hybrid circuits, and any other type of "circuit." In this regard, the control system 156 may include any type of component for accomplishing or facilitating achievement of the operations described herein. For example, a circuit as described herein may include one or more transistors, logic gates (e.g., NAND, AND, NOR, OR, XOR, NOT, XNOR, etc.), resistors, multiplexers, registers, capacitors, inductors, diodes, wiring, and so on). The control system 156 may also include programmable hardware devices such as field programmable gate arrays, programmable array logic, programmable logic devices or the like. The control system 156 may include one or more memory devices for storing instructions that are executable by the processor(s) of the control system 156. The one or more memory devices and processor(s) may have the same definition as provided below with respect to the memory device 152 and processor 148. In some hardware unit configurations, the control system 156 may be geographically dispersed throughout separate locations in the vehicle. Alternatively and as shown, the control system 156 may be embodied in or within a single unit/housing, which is shown as the controller 140.

In the example shown, the controller 140 includes the processing circuit 144 having the processor 148 and the memory device 152. The processing circuit 144 may be structured or configured to execute or implement the instructions, commands, and/or control processes described herein with respect to control system 156. The depicted configuration represents the control system 156 as machine or computer-readable media. However, as mentioned above, this illustration is not meant to be limiting as the present disclosure contemplates other embodiments where the control system 156, or at least one circuit of the control system 156, is configured as a hardware unit. All such combinations and variations are intended to fall within the scope of the present disclosure.

The hardware and information processing components used to implement the various processes, operations, illustrative logics, logical blocks, modules and circuits described in connection with the embodiments disclosed herein (e.g., the processor 148) may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, or state machine. A processor also may be implemented as a combination of computing devices, such as a combination of a DSP and a microprocessor, a plurality of microprocessors, one or more microprocessors in conjunction with a DSP core, or any other such configuration. In some embodiments, the one or more processors may be shared by multiple circuits (e.g., control system 156 may comprise or otherwise share the same processor which, in some example embodiments, may execute instructions stored, or otherwise accessed, via different areas of memory). Alternatively or additionally, the one or more processors may be structured to perform or otherwise execute certain operations independent of one or more co-processors. In other example embodiments, two or more processors may be coupled via a bus to enable independent, parallel, pipelined, or multi-threaded instruction execution. All such variations are intended to fall within the scope of the present disclosure.

The memory device 152 (e.g., memory, memory unit, storage device) may include one or more devices (e.g., RAM, ROM, Flash memory, hard disk storage) for storing information and/or computer code for completing or facilitating the various processes, layers and modules described in the present disclosure. The memory device 152 may be communicably connected to the processor 148 to provide computer code or instructions to the processor 148 for executing at least some of the processes described herein. Moreover, the memory device 152 may be or include tangible, non-transient volatile memory or non-volatile memory. Accordingly, the memory device 152 may include database components, object code components, script components, or any other type of information structure for supporting the various activities and information structures described herein.

The healthy model 160 is structured to determine a second NOx value of a healthy SCR model. In some embodiments, the healthy model 160 institutes a healthy virtual SCR that receives information from the sensor array and generates healthy outputs of a healthy virtual SCR catalyst. In some embodiments, the healthy virtual SCR catalyst operates in the same way as a new catalyst. In some embodiments, the healthy virtual SCR catalyst operates above a threshold degradation (e.g., absorption, adsorption, storage capacity, etc.). In some embodiments, the healthy model 160 receives the same sensor information from the sensor array that is used by the controller 140 to operate the engine system 100. In some embodiments, the healthy output includes a healthy NOx output defining a grams per second (g/s) value of NOx exiting the healthy virtual SCR catalyst. In some embodiments, the healthy NOx output includes a moles per second (mole/s) value of NOx exiting the healthy virtual SCR catalyst. In some embodiments, the healthy model 160 includes a physics based model, an algorithm, an artificial intelligence or machine learning engine, or another model architecture.

The degraded model 164 is structured to determine a third NOx value of a degraded SCR model. In some embodiments, the degraded model 164 institutes a degraded virtual SCR that receives information from the sensor array and generates degraded outputs of a degraded virtual SCR catalyst. In some embodiments, the degraded virtual SCR catalyst operates in the same way as a failed catalyst. In some embodiments, the degraded virtual SCR catalyst operates below a threshold degradation (e.g., absorption, adsorption, storage capacity, etc.). In some embodiments, the degraded model 164 receives the same sensor information from the sensor array that are used by the controller 140 to operate the engine system 100. In some embodiments, the degraded output includes a degraded NOx output defining a grams per second (g/s) value of NOx exiting the degraded virtual SCR catalyst. In some embodiments, the degraded NOx output includes a moles per second (mole/s) value of NOx exiting the degraded virtual SCR catalyst. In some embodiments, the degraded model 164 includes a physics based model, an algorithm, an artificial intelligence or machine learning engine, or another model architecture.

The degradation circuit 168 is structured to compute at least one degradation factor based on an ammonia slip, a first NOx value, the second NOx value, and the third NOx value. In some embodiments, the degradation circuit 168 integrates information received from the sensor array, the healthy model 160, and the degraded model 164 over a sample period. In some embodiments, the sample period is a calibratable amount of time. For example, the sample period can be twelve to fifteen second. In some embodiments, the degradation circuit 168 receives temperature information and exhaust flow rate information. In some embodiments, the degradation circuit 168 receives an integrated SCR Out NOx value, the healthy output from the healthy model 160, the degraded output from the degraded model 164, and NH3 dosing rates from the SCR system 123. Using the received information, the degradation circuit 168 determines NH3 slip events. In some embodiments, the degradation circuit 168 includes a NH3 slip flag or status that can be set to TRUE when NH3 slip is occurring, and FALSE when no NH3 slip is occurring. The degradation circuit 168 also compares the integrated SCR In NOx to a first threshold in the form of an upper threshold and a second threshold in the form of a lower threshold. The degradation circuit 168 calculates a degradation factor during normal operation (e.g., no NH3 slip, NH3 slip flag is FALSE) using a first calculation in the form of a normal operation calculation. In some embodiments, the normal operation calculation is:

$$\text{degradation factor} = \frac{\int SCR\ \text{Out}\ NOx - \int \text{healthy output}}{\int \text{degraded output} - \int \text{healthy output}}$$

The degradation circuit 168 calculates a degradation factor during abnormal operation (e.g., NH3 slip, NH3 slip flag is TRUE, NH3 slip above a threshold value) using a second calculation in the form of a NH3 slip calculation. In some embodiments, the NH3 slip calculation is:

$$\text{degradation factor} = \frac{\int SCR\ \text{Out}\ NOx - \text{calculated}\ NH3\ \text{Slip} - \int \text{healthy output}}{\int \text{degraded output} - \int \text{healthy output}}$$

In some embodiments, the degradation circuit 168 calculates a degradation factor during abnormal operation when NH3 slip is occurring and the SCR In NOx is greater than the upper threshold or greater than the lower threshold and NH3 slip flag becomes False.

In one example, the healthy output is five grams (5 g), the degraded output is ten grams (10 g), the SCR Out NOx is seven grams (7 g), and the degradation factor is 0.4. In another example, the healthy output is five grams (5 g), the degraded output is ten grams (10 g), the SCR Out NOx is three grams (3 g), and the degradation factor is −0.4. In another embodiment, the healthy output is five grams (5 g), the degraded output is ten grams (10 g), the SCR Out NOx is twelve grams (12 g), and the degradation factor is 1.4.

The weight factor circuit 172 is structured to define weight factor bins. In some embodiments, the weight factor circuit 172 defines sixteen bins. In some embodiments, the weight factor circuit 172 defines more than sixteen or less than sixteen bins. Each weight factor bin is assigned a range of degradation factor values. For example, a first bin can receive degradation factor values between zero and $1/16^{th}$, and a second bin can receive degradation factor values between $1/16^{th}$ and $1/8^{th}$, etc. The weight factor circuit 172 receives the degradation factors calculated by the degradation circuit and assigns the degradation factors to bins. The weight factor circuit 172 then counts the number of degradation factors in each bin. The weight factor circuit 172 also assigns a failed set of bins corresponding to degradation factors that are determined to be failed. For example, all bins holding degradation factor values above 0.5 may be assigned as failed bins. A healthy set of bins is also assigned and corresponds to degradation factor values that are determined to be healthy. For example, all the bins holding degradation factor values below 0.5 may be assigned as healthy bins.

The outlier circuit 176 is structured to analyze the counts in the bins of the weight factor circuit 172. The outlier circuit 176 determines a classification ratio as follows:

$$\text{classification ratio} = \frac{\text{total count in failed bins}}{\text{total count in all bins}}$$

The classification ratio is then used to determine whether the SCR system 123 is operating with a high weight factor (failed degradation factors) or a low weight factor (healthy degradation factors). In some embodiments, the classification ratio is compared to the classification threshold and when the classification ratio is greater than the classification threshold then the SCR system 123 is determined to be operating with a high weight factor. When the SCR system 123 is determined to be operating with a high weight factor, then the outlier circuit 176 takes a weighted average of the top two bins out of the high weight factor bins (e.g., the failed bins). When the SCR system 123 is determined to be operating with a low weight factor, then the outlier circuit 176 takes a weighted average of the top two bins out of the low weight factor bins (e.g., the healthy bins). The weighted average determined by the outlier circuit 176 is then used to determine if the SCR catalyst 126 has failed.

Figure 3:
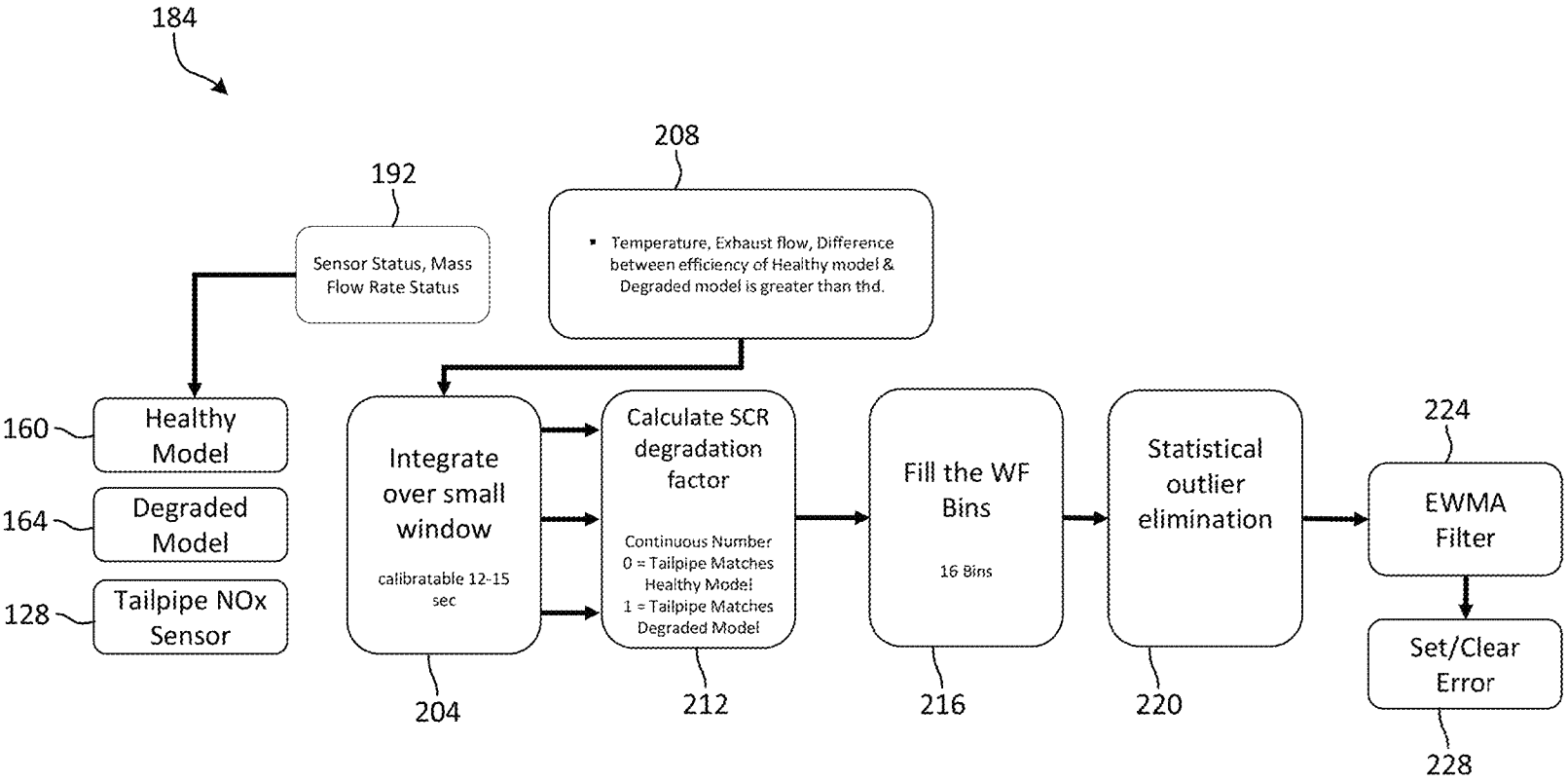
FIG. 3 is a flow diagram of a method of operation of the aftertreatment diagnostic system of FIG. 1 according to some embodiments.

As shown in FIG. 3, an aftertreatment diagnostic method 184 of operating the engine system 100. The aftertreatment diagnostic system (e.g., the controller 140) includes one or more memory devices having computer-readable instructions stored thereon, and one or more processors programmed to execute the computer-readable instructions to: determine a first NOx value at an outlet of a Selective Catalytic Reduction (SCR) system of an aftertreatment system; determine an ammonia (NH3) slip value based at least in part on the first NOx value; determine a second NOx value of a healthy SCR model; determine a third NOx value of a degraded SCR model; compute at least one degradation factor based on the ammonia slip, the first NOx value, the second NOx value, and the third NOx value; and diagnose a normal operation or an abnormal operation of the SCR system based on the degradation factor.

At step 192, the sensor information (e.g., from the sensor array 127/128) is provided to the healthy model 160 and the degraded model 164. The healthy model outputs, the degraded model outputs, and the SCR Out NOx from the sensors 127/128 is provided to the degradation circuit 168 at step 204. The healthy model outputs, the degraded model outputs, and the SCR Out NOx are then integrated over the sample period. In some embodiments, the healthy model outputs, the degraded model outputs, and the SCR Out NOx provide outputs with the units grams/per second. The degradation circuit 168 can also receive additional information at step 208 including temperature, exhaust flow, and a comparison of a difference between the healthy model outputs and the degraded model outputs and a threshold.

At step 212, the degradation circuit 168 calculates a degradation factor as described above. In some embodiments, the one or more processors are programmed to compute the at least one degradation factor by determining a first degradation factor as (the first NOx value–the NH3 slip value–the healthy NOx value)/(the degraded NOx value–the healthy NOx value) when the NH3 slip value is greater than an NH3 slip threshold. In some embodiments, the one or more processors are programmed to compute the at least one degradation factor by determining a second degradation factor as (the first NOx value–the healthy NOx value)/(the degraded NOx value–the healthy NOx value) when the NH3 slip value is less than an NH3 slip threshold. In some embodiments, the one or more processors are programmed to compute the at least one degradation factor by: determining a first degradation factor as (the first NOx value–the NH3 slip value–the healthy NOx value)/(the degraded NOx value–the healthy NOx value) when the NH3 slip value is greater than an NH3 slip threshold; and determining a second degradation factor as (the first NOx value–the healthy NOx value)/(the degraded NOx value–the healthy NOx value) when the NH3 slip value is less than an NH3 slip threshold. In some embodiments, the one or more processors are programmed to compute the at least one degradation factor by determining the first degradation factor during a first sampling period, and determining the second degradation factor during a second sampling period. In some embodiments, the one or more processors are programmed to diagnose the normal operation or the abnormal operation of the SCR system by determining that operation of the SCR system corresponds to the healthy SCR model based on the degradation factor being within a predetermined threshold, and determining that operation of the SCR system corresponds to the degraded SCR model based on the degradation factor being greater than the predetermined threshold.

At step 216, the degradation factor determined in step 212 is provided to the weight factor circuit 172 and sorted into a weight factor bin. In some embodiments, the one or more processors are programmed to diagnose the normal operation or the abnormal operation of the SCR system by sorting the at least one degradation factor into one of a plurality of weight factor bins after a sampling period, determine a total count in each of the plurality of weight factor bins at the end of a predetermined time period, and diagnose the normal operation or the abnormal operation of the SCR system based on the total count. In some embodiments, the plurality of weight factor bins includes a plurality of failed weight factor bins and a plurality of healthy weight factor bins and the one or more processors are programmed to diagnose the normal operation or the abnormal operation of the SCR system by determining a failed count within the plurality of failed weight factor bins, determining a healthy count within the plurality of healthy weight factor bins, and diagnosing the normal operation or the abnormal operation of the SCR system based on a ratio of the failed count and the total count. At step 220, the outlier circuit 176 analyzes the weight factor bins and generates an output in the form of a weighted average degradation factor. In some embodiments, the one or more processors are programmed to diagnose the normal operation or the abnormal operation of the SCR system by comparing the ratio of the failed count and the total count to a threshold, selecting two of the plurality of failed weight factor bins including the highest counts, determining a filtered output using an exponential weighted moving average filter on the two selected bins, and generating a fault code based on the filtered output. In some embodiments, the one or more processors are programmed to diagnose the normal operation or the abnormal operation of the SCR system by comparing the ratio of the failed count and the total count to a threshold, selecting two of the plurality of failed weight factor bins including the highest counts, determining a pre-filtered output based on a weighted average of the selected two failed weight factor bins, determining a post-filtered output by passing the pre-filtered output through an exponential weighted moving average filter, and generating a fault code based on the post-filtered output.

At step 224, the weighted average degradation factor is processed by an exponential weighted moving average filter. At step 228, a fault is determined. In some embodiments, the controller 140 includes an error flag that is set when the SCR catalyst 126 is failed, and the error flag is cleared when the SCR catalyst 126 is healthy. In some embodiments, the controller 140 (e.g., an ECM) implements at least one of the following actions when the error flag is triggered: 1. DEF injection actuator could be limited or completely turned off; 2. engine power output could be limited to avoid risk of DEF deposits, damage to after-treatment systems, or prevent excessive NH3/NOx release at exhaust outlet; 3. light an on-board MIL lamp and/or DEF lamp to indicate failure and promote a fix as soon as possible; and/or 4. communicate fault status of the vehicle to fleet management software and/or to truck manufacturer databases.

Figure 4:
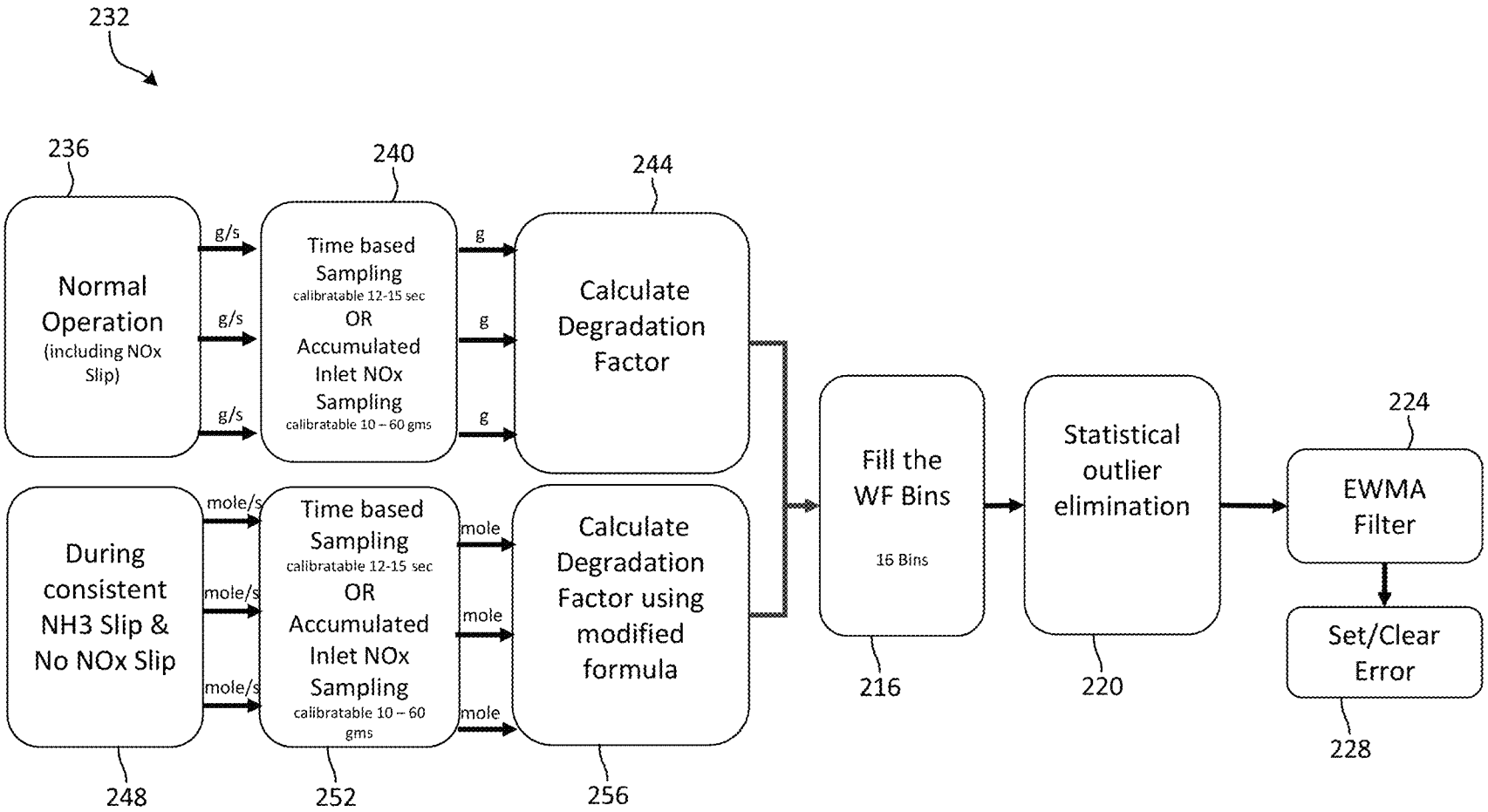
FIG. 4 is a flow diagram of a method of operation of the aftertreatment diagnostic system of FIG. 1 according to some embodiments.

As shown in FIG. 4, an aftertreatment diagnostic method 232 of operating the engine system 100. At step 236, the controller 140 determines that the SCR system 123 is operating under normal operation with no NH3 slip, and provides outputs from the healthy model 160, the degraded model 164, and the SCR Out NOx from the sensors 127/128. At step 240, the degradation circuit 168 integrates the healthy model outputs, the degraded model outputs, and the SCR Out NOx over the sample period. In some embodiments, the healthy model outputs, the degraded model outputs, and the SCR Out NOx provide outputs with the units grams/per second. The degradation circuit 168 can also receive additional information at step 240 including temperature, exhaust flow, and a comparison of a difference between the healthy model outputs and the degraded model outputs and a threshold. In some embodiments, the sample period is a time (e.g., 12-15 seconds). In some embodiments, the sample period includes an accumulated inlet NOx (e.g., 10-60 grams). Then, at step 244, the degradation circuit 168 calculates a degradation factor using the normal operation calculation.

At step 248, the controller 140 determines that the SCR system 123 is operating under NH3 slip operation with NH3 slip above a threshold, and provides outputs from the healthy model 160, the degraded model 164, and the SCR Out NOx from the sensors 127/128. At step 252, the degradation circuit 168 integrates the healthy model outputs, the degraded model outputs, and the SCR Out NOx over the sample period. In some embodiments, the healthy model outputs, the degraded model outputs, and the SCR Out NOx provide outputs with the units moles/per second. The degradation circuit 168 can also receive additional information at step 252 including temperature and exhaust flow. In some embodiments, the sample period is a time (e.g., 12-15 seconds). In some embodiments, the sample period includes an accumulated inlet NOx (e.g., 10-60 grams). Then, at step 256, the degradation circuit 168 calculates a degradation factor using the NH3 slip calculation.

The degradation factors calculated in steps 244 and 256 are then processes by the weight factor circuit 172 at step 216, as discussed above. At step 220, the outlier circuit 176 analyzes the weight factor bins and generates an output in the form of a weighted average degradation factor. At step 224, the weighted average degradation factor is processed by an exponential weighted moving average filter. At step 228, a fault is determined.

Figure 5:
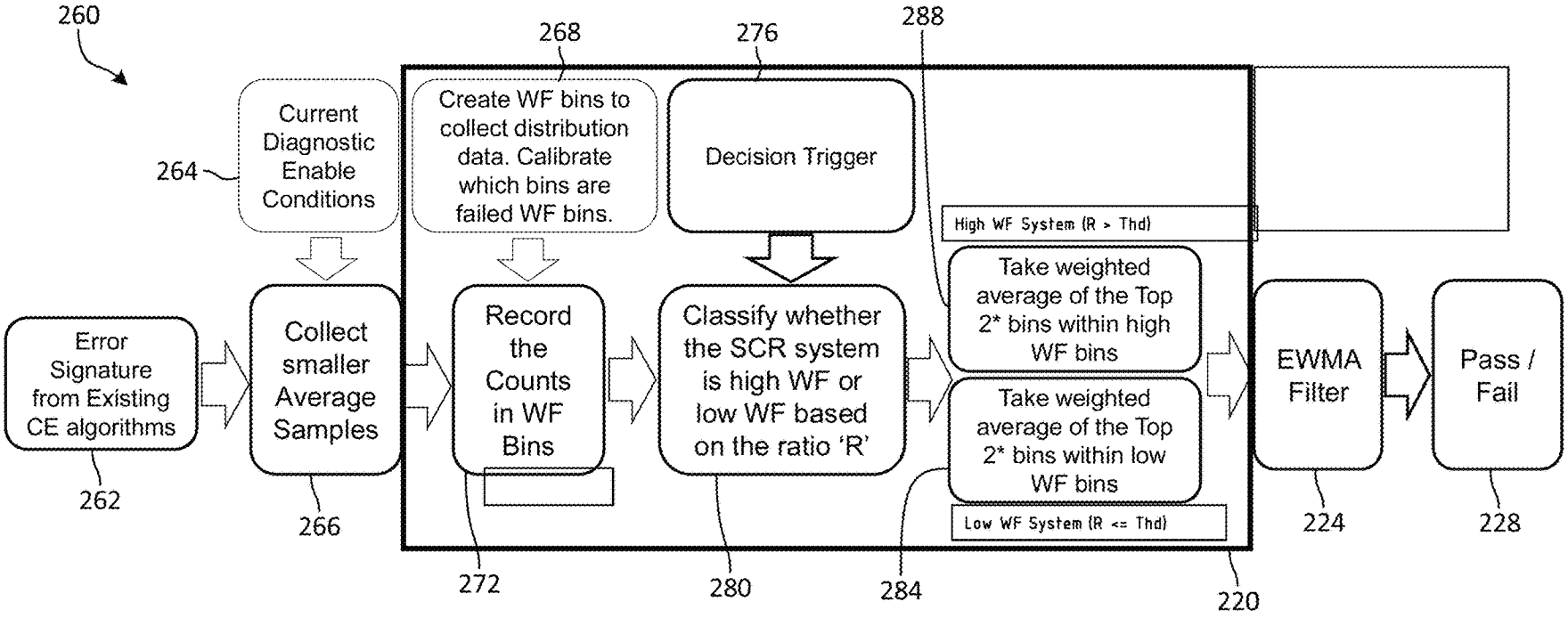
FIG. 5 is a flow diagram of a method of operation of the aftertreatment diagnostic system of FIG. 1 according to some embodiments.

As shown in FIG. 5, a method of statistical outlier elimination 260 used by the outlier circuit 176 of the controller 140 includes receiving the healthy model outputs, the degraded model outputs, and the SCR Out NOx at step 262 and checking for diagnostic enabling conditions at step 264. In some embodiments, the diagnostic enabling conditions include NH3 slip is occurring and that the SCR In NOx is greater than the upper threshold or greater than the lower threshold and NH3 Slip becomes False. At step 266, the degradation circuit 168 calculates the degradation factor and the weight factor circuit 172 sorts the degradation factors into weight factor bins.

The statistical outlier elimination step 220 includes creating the weight factor bins (e.g., 16 weight factor bins) and determining which bins are associated with failed SCR catalyst 126 behavior at step 268. At step 272, the outlier circuit 176 records counts of degradation factors within each weight factor bin. At step 276, the outlier circuit 176 calculates the classification ratio using the following equation:

$$\text{classification ratio } (R) = \frac{\text{total count in failed bins}}{\text{total count in all bins}}$$

At step 280, the outlier circuit 176 compares the classification ratio (R) to a classification threshold. In some embodiments, the classification threshold is 0.5. In some embodiments, the classification threshold in between 0.25 and 0.75. When the classification ratio is less than or equal to the classification threshold, the outlier circuit 176 determines a low weight factor system (e.g., setting a Low WF flag) at step 284. When the SCR system 123 is determined to be a low weight factor system, the outlier circuit 176 determines a weighted average of the degradation factors saved in the top two healthy weight factor bins. In some embodiments, the outlier circuit 176 determines the weighted average of the degradation factors saved in a different number of weight factor bins (e.g., one, three, or four weight factor bins). For example, if weight factor bins 14 and 15 are the top two bins, then the weighted average of degradation factors ($WA_{DF}$) is taken from bins 14 and 15. In some embodiments, the weighted average of degradation factors ($WA_{DF}$) is calculated the using following equation:

$$WA_{DF} = \frac{(\text{number of } DF \text{ in } Bin\ 14 \times \text{average of } DFs \text{ in Bin } 14) + (\text{number of } DF \text{ in Bin } 15 \times \text{average of } DFs \text{ in Bin } 15)}{\text{number of } DF \text{ in Bin } 14 + \text{number of } DF \text{ in Bin } 15}$$

In some embodiments, in case there is a tie for selecting the top two bins (e.g., two bins have the same count), then the outlier circuit 176 selects the lower numbered bin. For example, if weight factor bin 14 and weight factor bin 12 have the same counts, the outlier circuit 176 will select the weight factor bin 12.

When the classification ratio is greater than the classification threshold, the outlier circuit 176 determines a high weight factor system (e.g., setting a High WF flag) at step 288. When the SCR system 123 is determined to be a high weight factor system, the outlier circuit 176 determines a weighted average of the degradation factors saved in the top two failed weight factor bins. In some embodiments, the outlier circuit 176 determines the weighted average of the degradation factors saved in a different number of weight factor bins (e.g., one, three, or four weight factor bins). In some embodiments, the same weighted average equation is used as discussed above with respect to step 284.

The weighted average degradation factors from step 284 or step 288 is then provided as an output of the statistical outlier elimination step 220 to the EWMA filter at step 224 as discussed above.

The method of statistical outlier elimination 260 uses a model-based method to calculate the inefficiency of the SCR catalyst 126. The method 260 can be enabled or disabled using the operator I/O device 130. When method of statistical outlier elimination 260 is enabled, the weighted average degradation factors from step 284 or step 288 is used for making a diagnostic update.

In some embodiments, the method of statistical outlier elimination 260 outputs the weighted average degradation factors from step 284 or step 288 when the engine 110 is turned off (e.g., key switch is off for a vehicle) and the total bin count is great than a first threshold in the form of a fast counter. The fast counter may include a time based algorithm and define a minimum number of degradation factors that have been sorted into weight factor bins. In some embodiments, the method of statistical outlier elimination 260 outputs the weighted average degradation factors from step 284 or step 288 when the total bin count is great than a second threshold in the form of a slow counter. The slow counter may include a time-based algorithm and define a minimum number of degradation factors that have been sorted into weight factor bins. In some embodiments, the slow counter defines a larger number of degradation factors than the fast counter. In some embodiments, the fast counter defines a minimum number of degradation factors over a first time-period, and the slow counter defines a minimum number of degradation factors over a second larger time period. If the sum of total bin counts (e.g., the total number of degradation factors sorted into bins) is less than fast counter and key switch is turned off or an operation cycle is complete, then the method of statistical outlier elimination 260 will not output the weighted average degradation factors from step 284 or step 288, and all the bin counts will be carried over to the next cycle.

Once the method of statistical outlier elimination 260 is enabled the statistical filtering is applied to the values of the weight factor bins and the weighted average degradation factors from step 284 or step 288 are outputted.

In some embodiments, the weight factor bins are set to zero after the weighted average degradation factors from step 284 or step 288 is output and steps 224 and 228 are complete. After the reset of the weight factor bins, the methods 184, 232, and/or 260 restart and continue to monitor the SCR system 123.

Figure 6:
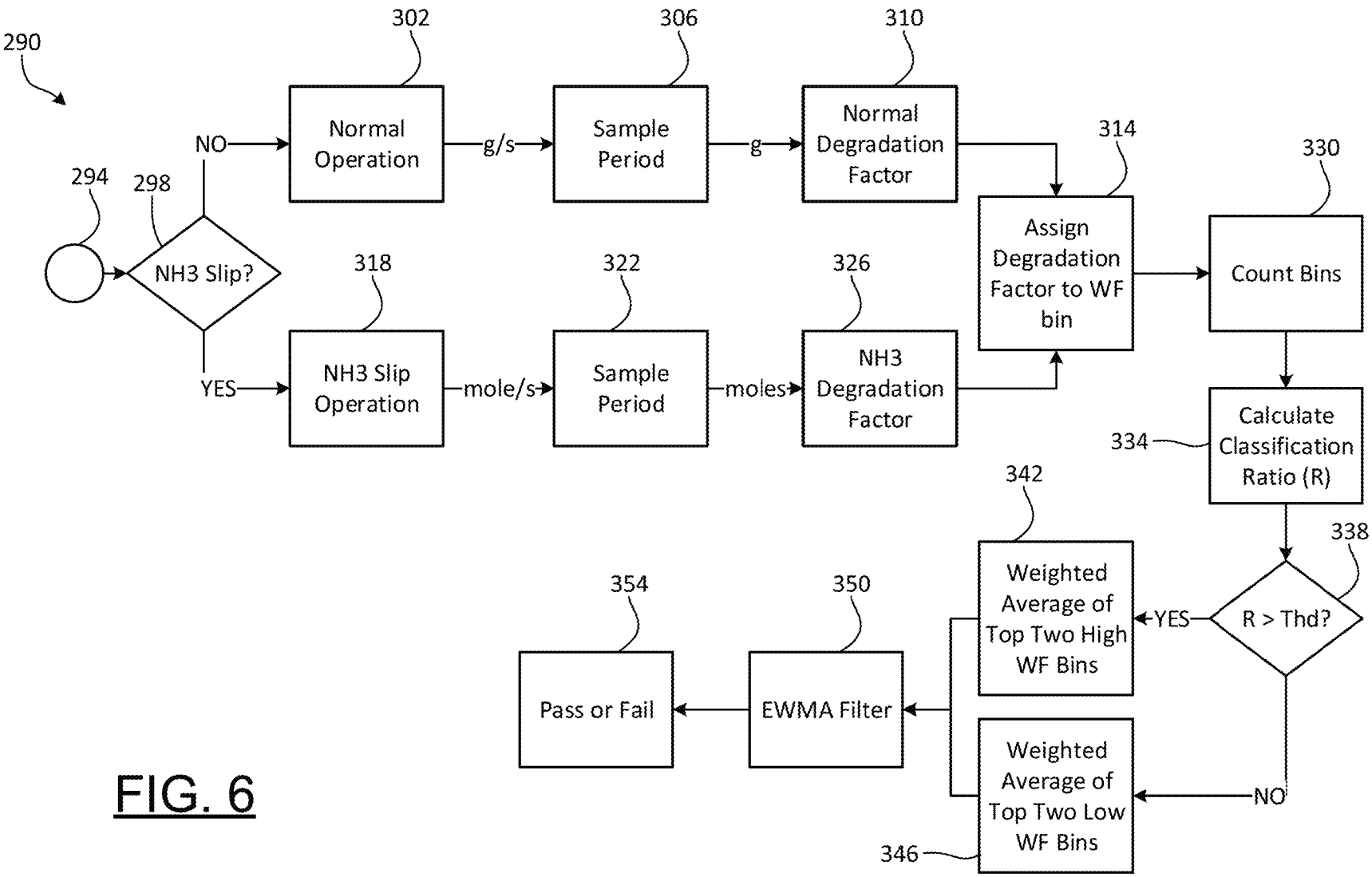
FIG. 6 is a flow diagram of a method of operation of the aftertreatment diagnostic system of FIG. 1 according to some embodiments.

As shown in FIG. 6, an aftertreatment diagnostic method 290 is implemented by the controller 140 and starts at step 294. At step 298, the controller 140 determines if the aftertreatment system 120 is experiencing NH3 slip. If no NH3 slip is determined, then the method progresses to step 302 and normal operation is determined. At step 306, outputs from the healthy model 160, the degraded model 164, and the sensor information are integrated over a sample period. The integrated outputs of step 306 are then used in step 310 to calculate a degradation factor using a normal operation calculation. At step 314, the degradation factor calculated in step 310 is assigned to one of a plurality of weight factor bins.

If the after treatment 120 is determined to be experiencing NH3 slip at step 298, then the method 290 progresses to step 318 and an abnormal or NH3 slip operation is determined. At step 322, outputs from the healthy model 160, the degraded model 164, and the sensor information are integrated over a sample period. The integrated outputs of step 322 are then used in step 326 to calculate a degradation factor using a NH3 slip calculation. At step 314, the degradation factor calculated in step 326 is assigned to one of the plurality of weight factor bins.

At step 330, each weigh factor bin is counted. In some embodiments, if a total count of all degradation factors within the weight factor bins is equal to or greater than a sampling threshold, then the method 290 progresses to step 334. If the total count of all degradation factors within the weight factor bins is less than the sampling threshold, the method 290 returns to step 298 and continues to collect degradation factors in the weight factor bins.

At step 334, a classification ratio is calculated based on the number of degradation factors sorted into each of the weight factor bins. In some embodiments, the classification factor is indicative of the distribution of bin counts. In some embodiments, a higher classification ratio corresponds to higher counts in failed weight factor bins.

At step 338, the classification ratio is compared to a classification ratio threshold. If the classification ratio is greater than the classification ratio threshold, then the method 290 progresses to step 342 and weighted average of high weight factor bins is determined. In some embodiments, high weight factor bins are determined to be failed bins associated with degradation factors above a failure threshold. In some embodiments, a subset of the high weight factor bins are selected. In some embodiments, the subset of the high weight factor bins includes the two weight factor bins of the high weight factor bins that include the largest count value (e.g., the highest number of degradation factors have been sorted into the bin). A weighted average of degradation factors in the selected bins is output from step 342.

If the classification ratio is less than or equal to the classification ratio threshold at step 338, then the method 290 progresses to step 346 and weighted average of low weight factor bins is determined. In some embodiments, low weight factor bins are determined to be healthy bins associated with degradation factors below the failure threshold. In some embodiments, a subset of the low weight factor bins are selected. In some embodiments, the subset of the low weight factor bins includes the two weight factor bins of the low weight factor bins that include the largest count value (e.g., the highest number of degradation factors have been sorted into the bin). A weighted average of degradation factors in the selected bins is output from step 346.

At step 350, an EWMA filter is applied. At step 354, a pass or fail determination is made by the controller based on the outputs from step 342 and 346. In some embodiments, the weighted average of selected degradation factors is compared to a pass/fail threshold. If the weighted average of selected degradation factors is greater than the pass/fail threshold, the SCR catalyst 126 is determined to be failed and a warning is generated and communicated to the operator.

In some embodiments, when NH3 Slip is not True (e.g., no NH3 slip) and also engine out NOx is greater than a calibratable threshold (e.g., 500 PPM), then the controller 140 determines the best catalyst efficiency under a predetermined number of bed temperatures (e.g., 5), and determines an average for a sample time and a Max/Best catalyst efficiency. The best catalyst efficiency values are selected for each of the catalyst bed temperature ranges and an instantaneous NH3 used during slip event (NH3 Used) is calculated for each bed temperature range using the following equation:

$$NH3 \text{ used} = \text{instantaneous } EONOx \times \text{Max/Best catalyst efficiency}$$

When NH3 Slip is True and no NOx slip is detected, then the controller 140 integrates NOx In, NOx Out, Healthy NOx, OBD NOx, and NH3 Used (in moles). When the NH3 slip flag becomes False and integrated NOx In (e.g., in grams) is greater than a calibratable lower threshold or the integrated NOx In (e.g., in grams) is greater than a calibratable higher threshold, then the controller 140 clears integrators and information collection starts again. The controller 140 accumulates all the integrated values for the above conditions for use by the controller 140 in determining the degradation factors. When NH3 Slip is True, the controller 140 integrates all signals and calculates a degradation factor if either of above-mentioned conditions goes TRUE.

In some embodiments, NOx Slip is determines using the following equation:

$$NOx \text{ Slip} = EONOx - NH3 \text{ Used}$$

In some embodiments, NH3 Slip is determines using the following equation:

$$NH3 \text{ Slip} = SONOx - NOx \text{ Slip}$$

If Max/Best catalyst efficiency out of a three temperature bucket is not calculated before a slip happens (e.g., a Cold Federal Test Procedure, Rated) and if the enable conditions discussed above are not met, then the controller 140 utilizes power down values for catalyst efficiencies and degradation factors. Then, in the next key cycle or operation of the engine system 100, a new catalyst efficiency is calculated.

If the ratio of NH3 Slip and EONOx is greater than 10-12% (calibratable) and Max/Best catalyst efficiency is greater than 95-99% (calibratable) and NH3 Slip is True, then a counter is incremented (high NH3 Slip Event Counter). The counter is decremented when the ratio of NH3 Slip and EONOx is less than 10-12% (calibratable) and Max/Best catalyst efficiency is greater than 95-99% (calibratable) and NH3 Slip is True. The output of the high NH3 Slip Event Counter will be input to a look-up table and an output of the look-up table will be a multiplier which will be multiplied to calculated NH3 Slip. This calculated final NH3 Slip is then subtracted from SONOx to determine a new weight factor formula during Slip Active. In some embodiments, the high NH3 Slip Event Counter value is saved after a key off event or a power down of the engine system 100.

In some embodiments, if a sensor negative offset is present, catalyst efficiency will be accurate, but the SCR catalyst 126 cannot hold NH3 and therefore the controller 140 will determine NH3 Slip when exhaust temperatures rise and then the high NH3 Slip Event Counter will increase. In this case, the controller 140 does not subtract total calculated NH3 Slip. Rather, the total calculated NH3 Slip is multiplied by a multiplier and then subtracted from SONOx to determine the new weight factor formula.

Figure 7:
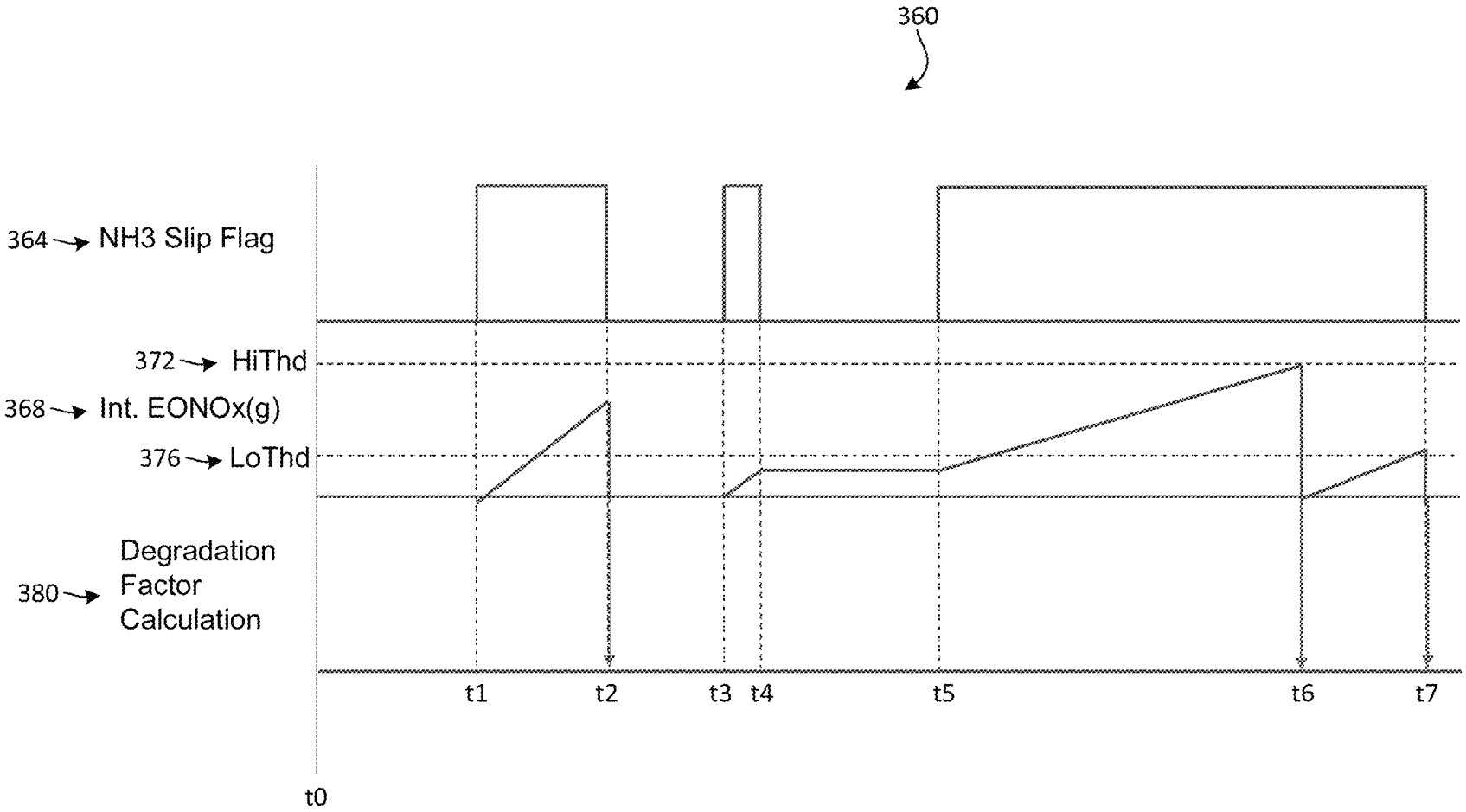
FIG. 7 is a graph showing implementation of the method of FIG. 6 according to some embodiments.

As shown in FIG. 7, a chart 360 shows how the controller 140 determines when to implement one or more of the methods 184, 232, 260, 290. A NH3 slip flag 364 indicates a NH3 slip event. In some embodiments, the NH3 flag 364 is a binary operator that is either one (NH3 slip occurring) or zero (no NH3 slip).

An integrated engine out NOx value 368 (e.g., SCR Out NOx) is compared to an upper threshold 372 and a lower threshold 376. A degradation factor is determined based on the NH3 slip flag 364 and the comparison of the integrated engine out NOx value 368 to the upper threshold 372 and the lower threshold 376. In some embodiments, a degradation factor is determined any time the integrated engine out NOx value 368 exceeds the upper threshold 372.

At a first time t1, the NH3 flag 364 is active (one), but the integrated engine out NOx value 368 is less than the lower threshold 376 so no degradation factor is determined. At a second time t2, the NH3 slip flag 364 becomes FALSE, and the integrated engine out NOx value 368 is greater than the lower threshold 376 so a degradation factor is determined. At a third time t3, the NH3 flag 364 is active (one), but the integrated engine out NOx value 368 is less than the lower threshold 376 so no degradation factor is determined. At a fourth time t4, the NH3 slip flag 364 becomes FALSE and the integrated engine out NOx value 368 is less than the lower threshold 376, so no degradation factor is determined. At a fifth time t5, the NH3 flag 364 is active (one), but the integrated engine out NOx value 368 is less than the lower threshold 376 so no degradation factor is determined. At a sixth time t6, the NH3 slip flag 364 is TRUE (e.g., active, one), and the integrated engine out NOx value 368 is greater than the upper threshold so a degradation factor is determined. At a seventh time t7, the NH3 slip flag 364 becomes FALSE, and the integrated engine out NOx value 368 is greater than the lower threshold 376 so a degradation factor is determined. Therefore, during operation of the engine system 100 as shown in FIG. 7, three degradation factors are determined using the NH3 slip calculation. In typical diagnostic systems, a degradation factor is not determined during NH3 slip. Methods 184, 232, 260, 290 described herein provide up to a fifty percent increase in-use time of SCR catalyst diagnostics.

Figure 8:
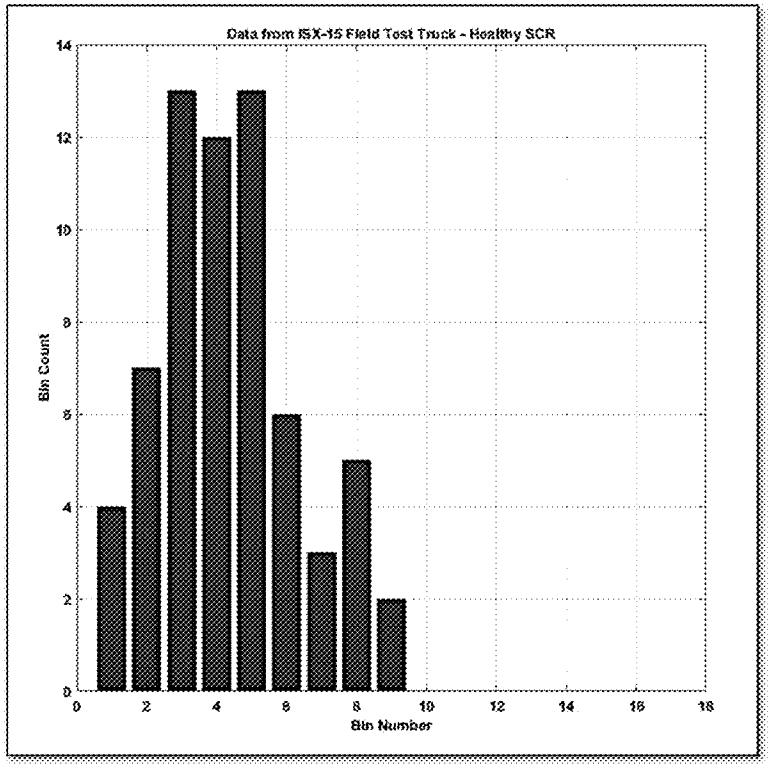
FIG. 8 is a graph showing a low weight factor bin distribution of the method of FIG. 6 according to some embodiments.

As shown in FIG. 8, a distribution 384 of degradation factor counts in the weight factor bins described above indicates a healthy SCR catalyst 126. In some embodiments, bins 3 and 5 would be selected by the outlier circuit 176 to determine the weighted average degradation factor output.

Figure 9:
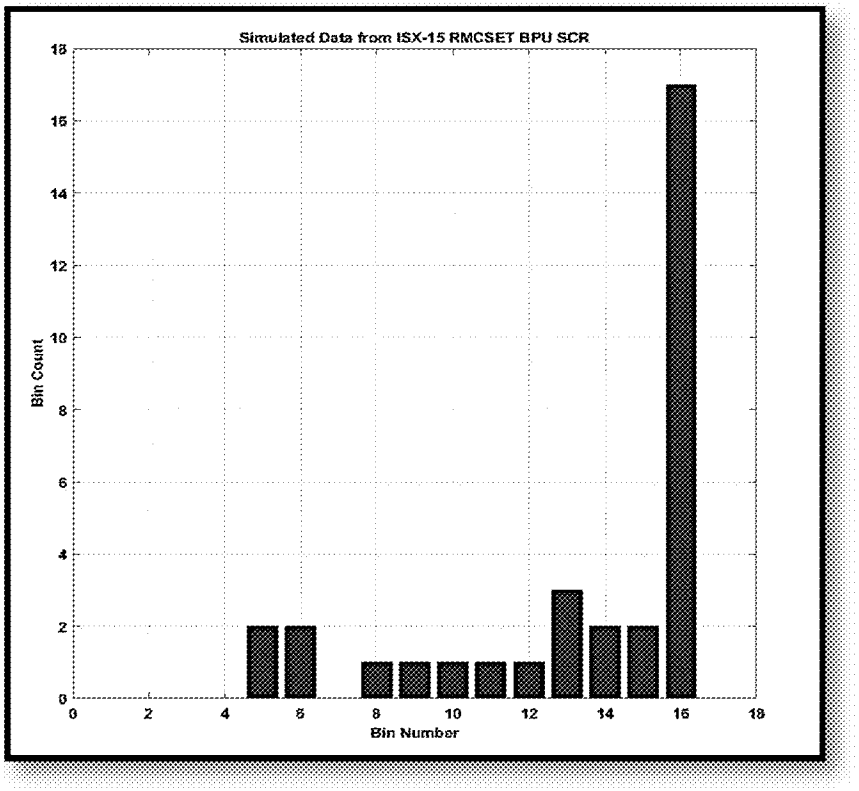
FIG. 9 is a graph showing a high weight factor bin distribution of the method of FIG. 6 according to some embodiments.

As shown in FIG. 9, a distribution 388 of degradation factor counts in the weight factor bins described above indicates a failed SCR catalyst 126. In some embodiments, bins 13 and 16 would be selected by the outlier circuit 176 to determine the weighted average degradation factor output.

Due to cross sensitivity of tail pipe NOx sensors to NH3 and system out NOx, it is difficult for typical diagnostics to differentiate between a failed catalyst and a healthy catalyst during NH3 Slip. Therefore, the typical diagnostics are paused during NH3 Slip conditions. The methods described herein allow the use of diagnostics during NH3 Slip conditions without impacting the capability/accuracy of the conversion efficiency diagnostics.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using one or more separate intervening members, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic. For example, circuit A communicably "coupled" to circuit B may signify that the circuit A communicates directly with circuit B (i.e., no intermediary) or communicates indirectly with circuit B (e.g., through one or more intermediaries).

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

While various circuits with particular functionality are shown in FIG. 2, it should be understood that the controller 140 may include any number of circuits for completing the functions described herein. For example, the activities and functionalities of the control system 156 may be combined in multiple circuits or as a single circuit. Additional circuits with additional functionality may also be included. Further, the controller 140 may further control other activity beyond the scope of the present disclosure.

As mentioned above and in one configuration, the "circuits" may be implemented in machine-readable medium for execution by various types of processors, such as the processor 148 of FIG. 2. An identified circuit of executable code may, for instance, comprise one or more physical or logical blocks of computer instructions, which may, for instance, be organized as an object, procedure, or function. Nevertheless, the executables of an identified circuit need not be physically located together, but may comprise disparate instructions stored in different locations which, when joined logically together, comprise the circuit and achieve the stated purpose for the circuit. Indeed, a circuit of computer readable program code may be a single instruction, or many instructions, and may even be distributed over several different code segments, among different programs, and across several memory devices. Similarly, operational information may be identified and illustrated herein within circuits, and may be embodied in any suitable form and organized within any suitable type of information structure. The operational information may be collected as a single information set, or may be distributed over different locations including over different storage devices, and may exist, at least partially, merely as electronic signals on a system or network.

While the term "processor" is briefly defined above, the term "processor" and "processing circuit" are meant to be broadly interpreted. In this regard and as mentioned above, the "processor" may be implemented as one or more general-purpose processors, application specific integrated circuits (ASICs), field programmable gate arrays (FPGAs), digital signal processors (DSPs), or other suitable electronic information processing components structured to execute instructions provided by memory. The one or more processors may take the form of a single core processor, multi-core processor (e.g., a dual core processor, triple core processor, quad core processor, etc.), microprocessor, etc. In some embodiments, the one or more processors may be external to the apparatus, for example the one or more processors may be a remote processor (e.g., a cloud based processor). Alternatively or additionally, the one or more processors may be internal and/or local to the apparatus. In this regard, a given circuit or components thereof may be disposed locally (e.g., as part of a local server, a local computing system, etc.) or remotely (e.g., as part of a remote server such as a cloud based server). To that end, a "circuit" as described herein may include components that are distributed across one or more locations.

Embodiments within the scope of the present disclosure include program products comprising machine-readable media for carrying or having machine-executable instructions or information structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or information structures and which can be accessed by a general purpose or special purpose computer or other machine with a processor. Combinations of the above are also included within the scope of machine-readable media. Machine-executable instructions include, for example, instructions and information which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the engine system 100 as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A non-transitory computer-readable medium comprising computer-readable instructions stored thereon that when executed by one or more processors of a controller cause the one or more processors to:

determine a first NOx value at an outlet of a selective catalytic reduction (SCR) system of an aftertreatment system;

determine an ammonia (NH3) slip value based at least in part on the first NOx value;

determine a second NOx value of a healthy SCR model;

determine a third NOx value of a degraded SCR model;

compute at least one degradation factor based on the ammonia slip, the first NOx value, the second NOx value, and the third NOx value; and diagnose a normal operation or an abnormal operation of the SCR system based on the at least one degradation factor.

2. The non-transitory computer-readable medium of claim 1, wherein to compute the at least one degradation factor, the one or more processors execute computer-readable instructions to:

determine that the NH3 slip value is greater than an NH3 slip threshold; and responsive to determining that the NH3 slip value is greater than the NH3 slip threshold, compute a first degradation factor of the at least one degradation factor by dividing a first value by a second value, the first value being a function of the first NOx value, the NH3 slip value, and the second NOx value, and the second value being a function of the third NOx value and the second NOx value.

3. The non-transitory computer-readable medium of claim 1, wherein to compute the at least one degradation factor, the one or more processors execute computer-readable instructions to:

determine that the NH3 slip value is less than an NH3 slip threshold; and responsive to determining that the NH3 slip value is less than the NH3 slip threshold, compute a second degradation factor of the at least one degradation factor by dividing a first value by a second value, the first value being a function of the first NOx value and the second NOx value, and the second value being a function of the third NOx value and the second NOx value.

4. The non-transitory computer-readable medium of claim 1, wherein to compute the at least one degradation factor, the one or more processors execute computer-readable instructions to:

compute a first degradation factor of the at least one degradation factor by dividing a first value by a second value, the first value being a function of the first NOx value, the NH3 slip value, and the second NOx value, and the second value being a function of the third NOx value and the second NOx value responsive to determining that the NH3 slip value is greater than an NH3 slip threshold; and compute a second degradation factor of the at least one degradation factor by dividing a first value by a second value, the first value being a function of the first NOx value and the second NOx value, and the second value being a function of the third NOx value and the second NOx value responsive to determining that the NH3 slip value is less than the NH3 slip threshold.

5. The non-transitory computer-readable medium of claim 4, wherein the one or more processors execute computer-readable instructions to:

compute the first degradation factor during a first sampling period; and compute the second degradation factor during a second sampling period.

6. The non-transitory computer-readable medium of claim 1, wherein to diagnose the normal operation or the abnormal operation of the SCR system, the one or more processors execute computer-readable instructions to:

determine that operation of the SCR system corresponds to the healthy SCR model based on the at least one degradation factor being within a predetermined threshold; and determine that the operation of the SCR system corresponds to the degraded SCR model based on the at least one degradation factor being greater than the predetermined threshold.

7. The non-transitory computer-readable medium of claim 1, wherein to diagnose the normal operation or the abnormal operation of the SCR system, the one or more processors execute computer-readable instructions to:

sort each of the at least one degradation factor into one of a plurality of weight factor bins after a sampling period;

determine a total count in each of the plurality of weight factor bins at the end of a predetermined time period; and diagnose the normal operation or the abnormal operation of the SCR system based on the total count.

8. The non-transitory computer-readable medium of claim 7, wherein the plurality of weight factor bins includes a plurality of failed weight factor bins and a plurality of healthy weight factor bins, and wherein to diagnose the normal operation or the abnormal operation of the SCR system, the one or more processors execute computer-readable instructions to:

determine a failed count within the plurality of failed weight factor bins; and diagnose the normal operation or the abnormal operation of the SCR system based on a ratio of the failed count and the total count.

9. The non-transitory computer-readable medium of claim 8, wherein to diagnose the normal operation or the abnormal operation of the SCR system, the one or more processors execute computer-readable instructions to:

determine that the ratio is greater than a threshold;

select a subset of the plurality of failed weight factor bins including the highest counts of the at least one degradation factor based on the ratio being greater than the threshold;

compute a pre-filtered output based on a weighted average of the selected subset of the plurality of failed weight factor bins;

compute a post-filtered output by passing the pre-filtered output through an exponential weighted moving average filter; and generate a fault code based on the post-filtered output indicating that the SCR system is abnormal.

10. The non-transitory computer-readable medium of claim 9, wherein the subset of the plurality of failed weight factor bins comprises two of the plurality of failed weight factor bins.

11. The non-transitory computer-readable medium of claim 8, wherein to diagnose the normal operation or the abnormal operation of the SCR system, the one or more processors execute computer-readable instructions to:

determine that the ratio is less than a threshold;

select a subset of the plurality of healthy weight factor bins including the lowest counts of the at least one degradation factor based on the ratio being less than the threshold;

compute a pre-filtered output based on a weighted average of the selected subset of the plurality of healthy weight factor bins;

compute a post-filtered output by passing the pre-filtered output through an exponential weighted moving average filter; and determine that the SCR system is normal based on the post-filtered output.

12. The non-transitory computer-readable medium of claim 11, wherein the subset of the plurality of healthy weight factor bins comprises two of the plurality of healthy weight factor bins.

13. A system comprising:

an aftertreatment system comprising a selective catalytic reduction (SCR) system; and a controller comprising one or more processors and the non-transitory computer-readable medium according to claim 1.

14. A method comprising:

determining, by at least one controller, a first NOx value at an outlet of a selective catalytic reduction (SCR) system of an aftertreatment system;

determining, by the at least one controller, an ammonia (NH3) slip value based at least in part on the first NOx value;

determining, by the at least one controller, a second NOx value of a healthy SCR model;

determining, by the at least one controller, a third NOx value of a degraded SCR model;

computing, by the at least one controller, at least one degradation factor based on the ammonia slip, the first NOx value, the second NOx value, and the third NOx value; and diagnosing, by the at least one controller, a normal operation or an abnormal operation of the SCR system based on the at least one degradation factor.

15. The method of claim 14, wherein to compute the at least one degradation factor, the method further comprises:

computing, by the at least one controller, a first degradation factor of the at least one degradation factor by dividing a first value by a second value, the first value being a function of the first NOx value, the NH3 slip value, and the second NOx value, and the second value being a function of the third NOx value and the second NOx value responsive to determining that the NH3 slip value is greater than an NH3 slip threshold; and computing, by the at least one controller, a second degradation factor of the at least one degradation factor by dividing a first value by a second value, the first value being a function of the first NOx value and the second NOx value, and the second value being a function of the third NOx value and the second NOx value responsive to determining that the NH3 slip value is less than the NH3 slip threshold.

16. The method of claim 14, wherein to diagnose the normal operation or the abnormal operation of the SCR system, the method further comprises:

sorting, by the at least one controller, each of the at least one degradation factor into one of a plurality of weight factor bins after a sampling period;

determining, by the at least one controller, a total count in each of the plurality of weight factor bins at the end of a predetermined time period; and diagnosing, by the at least one controller, the normal operation or the abnormal operation of the SCR system based on the total count.

17. The method of claim 16, wherein the plurality of weight factor bins includes a plurality of failed weight factor bins and a plurality of healthy weight factor bins, and wherein to diagnose the normal operation or the abnormal operation of the SCR system, the method further comprises:

determining, by the at least one controller, a failed count within the plurality of failed weight factor bins; and diagnosing, by the at least one controller, the normal operation or the abnormal operation of the SCR system based on a ratio of the failed count and the total count.

18. The method of claim 17, wherein to diagnose the normal operation or the abnormal operation of the SCR system, the method further comprises:

determining, by the at least one controller, that the ratio is greater than a threshold;

selecting, by the at least one controller, a subset of the plurality of failed weight factor bins including the highest counts of the at least one degradation factor based on the ratio being greater than the threshold;

computing, by the at least one controller, a pre-filtered output based on a weighted average of the selected subset of the plurality of failed weight factor bins;

computing, by the at least one controller, a post-filtered output by passing the pre-filtered output through an exponential weighted moving average filter; and generating, by the at least one controller, a fault code based on the post-filtered output indicating that the SCR system is abnormal.

19. The method of claim 17, wherein to diagnose the normal operation or the abnormal operation of the SCR system, the method further comprises:

determining, by the at least one controller, that the ratio is less than a threshold;

selecting, by the at least one controller, a subset of the plurality of healthy weight factor bins including the lowest counts of the at least one degradation factor based on the ratio being less than the threshold;

computing, by the at least one controller, a pre-filtered output based on a weighted average of the selected subset of the plurality of healthy weight factor bins;

computing, by the at least one controller, a post-filtered output by passing the pre-filtered output through an exponential weighted moving average filter; and determining, by the at least one controller, that the SCR system is normal based on the post-filtered output.

20. The method of claim 19, wherein the subset of the plurality of healthy weight factor bins comprises two of the plurality of healthy weight factor bins.

* * * * *